US009296206B2

(12) United States Patent
Achatz et al.

(10) Patent No.: US 9,296,206 B2
(45) Date of Patent: Mar. 29, 2016

(54) PRINT GROUP FOR AN INK PRINTING APPARATUS

(71) Applicants: Augustinus Achatz, Bayern (DE); Lucian Petrut, Poing (DE); Robert Sigismund, Putzbrunn (DE); Sebastian Wachter, Munich (DE)

(72) Inventors: Augustinus Achatz, Bayern (DE); Lucian Petrut, Poing (DE); Robert Sigismund, Putzbrunn (DE); Sebastian Wachter, Munich (DE)

(73) Assignee: Océ Printing Systems GmbH & CO. KG, Poing (DE)

( * ) Notice: Subject to any disclaimer, the term of this patent is extended or adjusted under 35 U.S.C. 154(b) by 0 days.

(21) Appl. No.: 14/279,384

(22) Filed: May 16, 2014

(65) Prior Publication Data

US 2014/0340445 A1 Nov. 20, 2014

(30) Foreign Application Priority Data

May 17, 2013 (DE) ..... 10 2013 105 077

(51) Int. Cl.
*B41J 2/165* (2006.01)

(52) U.S. Cl.
CPC ..... *B41J 2/16505* (2013.01); *B41J 2/16511* (2013.01); *B41J 2/16588* (2013.01)

(58) Field of Classification Search
USPC ..... 347/22, 24, 29, 32
See application file for complete search history.

(56) References Cited

U.S. PATENT DOCUMENTS

| | | | | |
|---|---|---|---|---|
| 5,663,751 | A * | 9/1997 | Holbrook | 347/22 |
| 6,224,187 | B1 | 5/2001 | Inten et al. | |
| 6,578,945 | B2 | 6/2003 | Hashi et al. | |
| 7,645,020 | B2 | 1/2010 | Mattern | |
| 8,419,162 | B2 * | 4/2013 | Sakano | 347/29 |
| 2007/0157962 | A1 | 7/2007 | Gronet | |

FOREIGN PATENT DOCUMENTS

| | | | |
|---|---|---|---|
| DE | 19726642 | C1 | 9/1998 |
| DE | 102005034029 | A1 | 2/2006 |
| EP | 0788882 | A2 | 8/1997 |
| EP | 2371552 | A1 | 10/2011 |
| EP | 2383120 | A1 | 11/2011 |

* cited by examiner

*Primary Examiner* — Lam Nguyen
(74) *Attorney, Agent, or Firm* — Schiff Hardin LLP

(57) ABSTRACT

In a print group for an ink printing apparatus, a housing is provided with print bars comprising print heads. The print bars are moveable independently of one another in a vertical direction from a printing position adjacent to a printing substrate into a park position and back. A protective flap bar for each print bar is provided which is pivotable and which is open to one side. The protective flap bar is arranged in a vertical position next to the print bar in the printing position such that the open side is facing away from the print bar. The protective flap bar is arranged in a horizontal position with the open side upward in the park position such that the print bar is engaged with its print head side in the protective flap bar.

11 Claims, 2 Drawing Sheets

PRINT GROUP FOR AN INK PRINTING APPARATUS

BACKGROUND

Ink printing apparatuses can be used for single-color or multicolor printing to a printing substrate (for example a single sheet or a web-shaped recording medium) made of the most varied materials (paper, for example). The design of such ink printing apparatuses is known; see for example EP 0 788 882 B1. Ink printing apparatuses that operate according to the Drop on Demand (DoD) principle, for example, have as a printing unit a print head or multiple print heads with nozzles comprising ink channels, the activators of which nozzles—controlled by a print controller—exciting ink droplets in the direction of the printing substrate, which ink droplets are directed towards said printing substrate in order to apply print dots there for a print image. The activators can generate ink droplets thermally (bubble jet) or piezoelectrically.

Given low print utilization of the ink printing apparatus, in the printing process not all nozzles of the ink print heads are activated; many nozzles have downtimes (print pauses), with the consequence that the ink in the ink channel of these nozzles is not moved. Due to the effect of the evaporation out of the nozzle opening, the danger exists that the viscosity of the ink then changes. This has the result that the ink in the ink channel can no longer move optimally and exit from the nozzle, for example. In extreme cases, the ink in the ink channel dries up completely and blocks the ink channel, such that a printing with this nozzle is no longer possible.

The drying of the ink in the nozzles can be prevented in that printing takes place from all nozzles within a predetermined cycle. This cycle can be adjusted corresponding to the print utilization. Individual points can thereby be applied in unprinted regions of the printing substrate, or dotted print lines can be printed between print pages. These methods can lead to disruptions in the print image, in addition to unnecessary ink consumption and additional wear of the print heads.

These problems in particular occur in color printers. For example, here print bars with print heads are arranged in a fixed position relative to one another as a printing unit. For example, print bars with five respective print heads can be provided, respectively one print bar for the colors black, cyan, magenta, and yellow. Here the problem exists that one or more colors are not used, for example given black-and-white printing. Multiple cleaning cycles are then required in order to make the unused print heads current again.

From U.S. Pat. No. 6,578,945 B2, given an ink printing apparatus with multiple print heads it is known to avoid the drying out of the nozzles in that the nozzles are sealed with protective caps. Given cleaning, ink emitted from the nozzles is thereby captured by the protective caps. In order to apply the protective caps on the nozzles, the printing unit with the print heads is moved upward, away from the printing substrate; the protective caps are driven into the intervening space between the printing unit and the printing substrate. The print heads are thereby cleaned. The protective caps are moved upward onto the print heads via elastic force, wherein the print heads are covered. The protective cap unit remains in this position until the printing unit should be used for printing again.

In US 2007/0157962 A1, an ink printing apparatus is described in which the print head can be moved vertically upward from the printing substrate, between a printing position and a position in which no printing is conducted. In this printing position, a protective cap made of rubber can be applied onto the nozzles of the print head.

From DE 10 2005 034 029 A1, an ink printing apparatus is known with multiple print heads arranged serially in the transport path of the printing substrate. The ink print heads serially print a resulting print image onto the printing substrate. Individual ink print heads can be deactivated and shifted to the side, for example in order to service these while the remaining print heads can continue to print.

DE 197 26 642 C1 describes a device for positioning an ink print head and a cleaning and sealing device. The ink print head can be swung from a printing position into a cleaning position and back again. A cleaning and sealing device can be displaced into the ink print head and away from this again. The cleaning and sealing device has a sealing cap and a wiping lip.

SUMMARY

An object is to specify for an ink printing apparatus a print group in which print bars (comprising print heads) and protective cap bars (provided to seal the print bars) can be positioned such that print bars that have a printing pause can be sealed with a protective cap bar while printing can take place with the remaining print bars.

In a print group for an ink printing apparatus, a housing is provided with print bars comprising print heads. The print bars are moveable independently of one another in a vertical direction from a printing position adjacent to a printing substrate into a park position and back. A protective flap bar for each print bar is provided which is pivotable and which is open to one side. The protective flap bar is arranged in a vertical position next to the print bar in the printing position such that the open side is facing away from the print bar. The protective flap bar is arranged in a horizontal position with the open side upward in the park position such that the print bar is engaged with its print head side in the protective flap bar.

DESCRIPTION OF EXEMPLARY EMBODIMENTS

Figure 1:
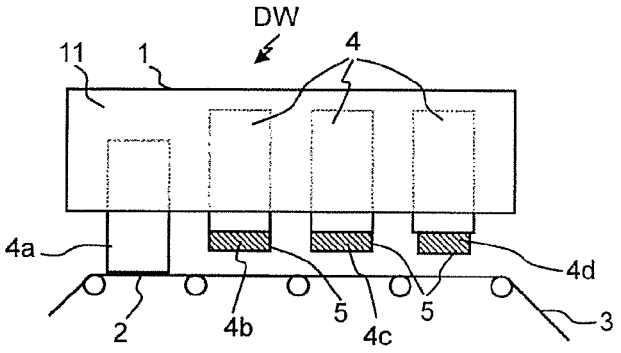
Fig. 1 (PRIOR ART)
FIG. 1 is a principle depiction of a front view of a print group.

For the purposes of promoting an understanding of the principles of the invention, reference will now be made to the preferred exemplary embodiments/best mode illustrated in the drawings and specific language will be used to describe the same. It will nevertheless be understood that no limitation of the scope of the of the invention is thereby intended, and such alterations and further modifications in the illustrated embodiments and such further applications of the principles of the invention as illustrated as would normally occur to one skilled in the art to which the invention relates are included herein.

In the print group according to an exemplary embodiment the print bars comprising print heads form a printing unit. In the printing unit, the print bars can be moved independently of one another between a printing position (in which a printing substrate can be printed to) and a position above the printing position. One protective flap bar that is borne so as to be pivotable is provided per print bar, which protective cap bar is designed as a trough that is open to one side. The print bars that are not used for printing can be moved into a park position, and there can be covered by their associated protective flap bars. For this, the protective flap bars can be swung out of a vertical position into a horizontal position, and the print bars can be fitted into the protective flap bars. The print bars used for printing are arranged in the printing position.

In the print group according to the exemplary embodiment it is ensured that the following requirements for the position of the print bar with the print heads are satisfied:

- In the printing unit, the print bars can assume a printing position in which the print bars with the print heads are positioned above the printing substrate.
- In the printing unit, the print bars can assume a printing position in which the print printing unit can be moved without damaging the print heads.
- In a park position of the printing unit, the print bars can be placed on protective flap bars in order to avoid the nozzles of the print heads drying out in print pauses.
- The printing unit can assume a service position in which (for example) the print heads are accessible in order to be able to clean their nozzle surfaces.

The print group according to the exemplary embodiment has the following advantages:

- The print heads on the print bars cannot dry out if unused, since these print bars are respectively sealed tight with a protective flap bar.
- The previously unused print bars are immediately ready for use if necessary. Long reactivation times and reactivation processes are not required.
- The service costs are significantly reduced since the unused print bars are protected against external influences (for example contamination or mechanical damage). Likewise, no additional ink is consumed and the wear of the print heads is reduced. Nevertheless, the advantages of a complete unit relative to completely individualized print bars remains due to the assembly of the print bars into one printing unit.

An exemplary embodiment is presented in schematic Figures described hereafter.

The design of a known print group DW according to US 2012/147092 A1, with a printing unit 1 and a transport unit 2 for a printing substrate 3, results from FIG. 1 for explanation in principle. For example, the printing unit 1 comprises four line-width print bars 4*a* through 4*f* that respectively provide print heads. The printing unit 1 has a housing 11 in which the print bars 4 are arranged. Drive and guidance units for the print bars 4 are provided in the housing 11, with which drive and guidance units the print bars 4 can be moved vertically relative to the plane of the printing substrate 3 within the housing 11, independently of one another. The printing unit 1 can furthermore be moved via an additional drive and guidance unit from an operating position (in which the printing unit 2 is arranged over the printing substrate 7 to be printed) into a cleaning position that lies next to the transport unit 2 for the printing substrate 3.

In operation, the printing unit 1 can take up two positions, wherein with the one drive and guidance unit the printing unit 1 can be moved from the one position into the other position and back:

- The printing unit 1 can be in the operating position, in which the printing unit 1 is situated above the printing substrate 3. This case is shown in FIG. 1.
- The printing unit 1 can be in the cleaning position, in which the printing unit 1 is arranged next to the transport unit 2 for the printing substrate 3.

In the printing unit 1, the print bar 4 can likewise assume two positions:

- The print bars 4 can be in the printing position, in which the print heads 4 can print to the printing substrate 3. For example, in FIG. 1 the print bar 4*a* is in the printing position.
- The print bars 4 can be brought upward (by their drive and guidance unit) into a park position in which no printing is possible. For example, in FIG. 1 the print bars 4*b* through 4*f* are in the park position.
- In the park position, the print bars 4 can be coupled with protective cap bars 5 in order to protect the print heads of the print bar 4.

The protective cap bars 5 can thereby be coupled with the associated print bars 4 in order to seal these, or they can be detached from these. In FIG. 1,

- the print bars 4*b* through 4*f* are protected with a protective cap bar 5;
- the print bar 4*a* has no protective cap bar 5 since it is in the printing position.

Figure 2:
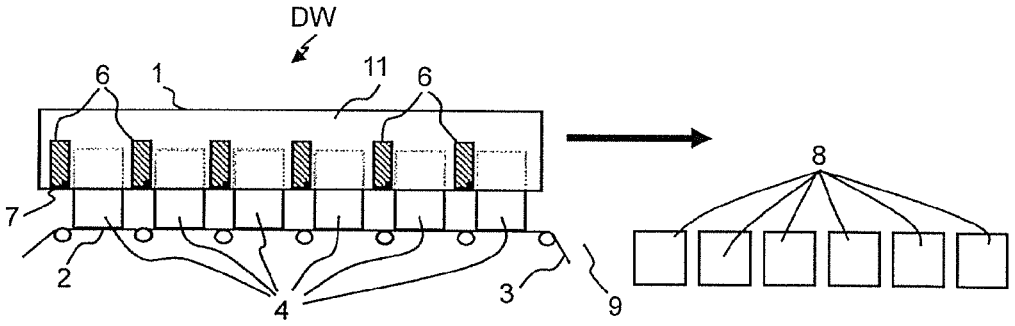
FIG. 2 is a principle depiction of a printing unit with print bars in the printing position, and with the arrangement of a cleaning position.

FIG. 2 shows a print group DW with a printing unit 1 according to the exemplary embodiment in which all print bars 4 are in the printing position. In contrast to FIG. 1, here protective flap bars 6 are provided instead of protective cap bars 5 according to FIG. 1, which protective flap bars 6 are arranged adjacent to the associated print bars 4 (respectively one protective flap bar 6 per print bar 4) and are respectively borne so as to be able to pivot around an axis 7. The protective flap bars 7 are designed as troughs, and therefore are open to one side and have such a dimensioning that the respective print bar 4 can be driven into its protective flap bar 6 and then is protected against drying out. For this, the protective flap bar 6 can have at the opening of the open side a seal that encompasses the print bar 4 so as to form a seal when said print bar 4 is inserted into the protective flap bar 6. If the print bars 4 are in the printing position, the protective flap bars 6 are folded up and are located in a vertical position next to the print bars 4, as FIG. 2 shows. To fold up the protective flap bars 6, the print bars 4 must be driven vertically upward so that the protective flap bars 6 can be pivoted.

According to FIG. 2, the printing unit 1 can be displaced (as viewed in the transport direction of the printing substrate web 3) from the operating position over the printing substrate 3 into a service position and cleaning position that are situated next to the transport device 2 for the printing substrate 3. For example, wiper units 8 can be arranged there, respectively one wiper unit 8 per print bar 4. The print bars 4 can be cleaned with the wiper units 8 in a known manner. A service position 9 in which the print bars 4 are externally accessible can be provided between the cleaning position and the operating position.

Figure 3:
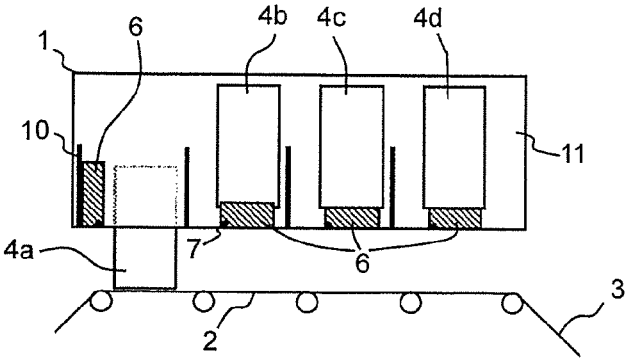
FIG. 3 is a print group in which one print bar is in the printing position, and the remaining print bars are in the park position.

FIG. 3 shows the printing unit 1 in the operating position, wherein the print bars 4*b* through 4*d* are in the park position and the print bars 4*a* is in the printing position. At the print bar 4*a*, the protective flap bar 6 is arranged in a vertical position; and at print bars 4*b* through 4*d*, the protective flap bars 6 are arranged in a horizontal position. In addition to the print bars 4, sealing plates 10 are provided onto which the protective flap bars 6 with the open side are pivoted into the vertical position so that these are sealed. In the horizontal position of the protective flap bars 6, the open sides of the protective flap bars 6 point upward, such that the print bars 4 engage with the print heads in the protective flap bars 6 upon being lowered into the park position and the nozzles are protected against drying out by the protective flap bars 6. If the opening of the respective protective flap bar 6 is surrounded with a seal, the print bars 4 with the print heads can be borne in the protective flap bars 6 with an air-tight seal.

The protective flap bars 6 can be permanently installed in the printing unit and can be moved with the printing unit 1; they can respectively be pivoted independently of one another around a rotation axis 7, for example they can be pivoted with the aid of one actuator per protective flap bar 6.

The protective flap bars 6 can be filled with a fluid. In the respective protective flap bar 6, the fluid generates a saturation of the air or a high humidity, and thereby prevents the print heads of the inserted print bar 4 from drying out. Since the respective protective flap bar 6 is sealed tight by the sealing plate 10 in the vertical position and by the print bar 4 in the horizontal position, an evaporation of the fluid can be largely prevented. Fluid can be supplied to the protective flap bars 6 via the print bars 4, for example, and can be drawn off again via the print bars 4.

Figure 4:
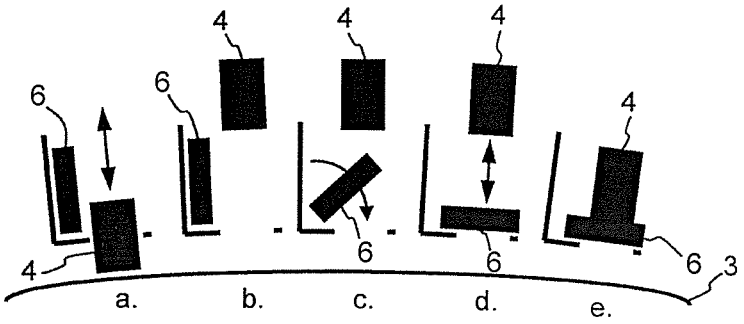
FIG. 4 is a depiction of the movement workflow of print bar and protective flap bar given movement of a print bar from the printing position into the park position.

The adjustment positions of the protective flap bars 6 and the pivoting process of the protective flap bars 6 are explained further using FIG. 4:

position vertical (FIG. 4*a*): the associated print bar 4 is in the printing position (FIG. 4*a*) over the printing substrate 3, or the print bars 4 are in the cleaning position over the associated wiper unit 8.

position horizontal (FIG. 4*e*): the associated print bar 4 is arranged in the park position on the protective flap bar 6; the print bar 4 is sealed by the protective flap bar 6; the printing unit 1 thereby is also sealed at the bottom by the protective flap bars 6 since these seal the openings for the print bars 4.

transition from the vertical position into the horizontal position (FIG. 4*b* through FIG. 4*d*):

the respective print bar 4 is directed vertically upward out of the printing position (FIG. 4*b*); the protective flap bar 6 is then pivoted from the vertical position (FIG. 4*b*) into the horizontal position (FIG. 4*c*, FIG. 4*d*); finally, the print bar 4 is directed downward into a park position (FIG. 4*d*) in which the print bar 4 engages with the print heads in the protective flap bar 6 and is therefore protected.

The guidance units for the print bars 4 can be realized corresponding to US 2012/147092 A1; this is referenced and incorporated as well as a disclosure.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A print group for an ink printing apparatus, comprising:

a transport unit for a printing substrate and a printing unit, said printing unit comprising a housing with internally arranged print bars comprising print heads;

drive and guidance units arranged per print bar in the housing of the printing unit for moving the print bars independently of one another in a vertical direction as viewed from the transport unit from a printing position situated adjacent to the printing substrate into a park position and back;

a protective flap bar comprising a trough for each print bar and borne so as to be pivotable and the trough being open to one side;

the protective flap bar being arranged in a vertical position next to the print bar in the printing position of said respective print bar such that the open side is facing away from the print bar; and the protective flap bar being arranged in a horizontal position with the open side upward in the park position of the printing unit such that the print bar is engaged with its print head side in the protective flap bar.

2. The print group according to claim 1 in which a sealing plate is arranged adjacent to the open side in the vertical position of the protective flap bar.

3. The print group according to claim 1 in which a seal is arranged at the open side of the protective flap bar so that said protective flap bar is sealed given an inserted print bar.

4. The print group according to claim 1 in which the protective flap bar is at least partially filled with fluid.

5. The print group according to claim 1 in which a drive and guidance assembly is arranged at the housing of the printing unit, and with the drive and guidance assembly the printing unit is moved from an operating position situated above the printing substrate into a cleaning position situated next to the transport unit and back.

6. A method for positioning print bars in a printing unit and comprising print heads and for positioning protective flap bars having a trough with an open side and provided to cover the print bars, the print bars being moveable independently of one another between a printing position in which a printing substrate is printed to a park position above the printing position in the printing unit, and the protective flap bars being borne so as to be pivotable adjacent to their associated print bars so that they can be pivoted from a vertical position into a horizontal position and back, comprising the steps of:

moving a print bar that is not being used for printing upward in a vertical direction, pivoting an associated protective flap bar into the horizontal position, and then lowering the print bar through the open side into the protective flap bar in a park position; and moving a print bar provided for printing away from the flap bar and out of the park position, pivoting the protective flap bar into the vertical position, and then moving the print bar into the printing position, the open side of the flap bar facing away from the print bar.

7. The method according to claim 6 in which in the event that individual print bars are used for printing said print bars are moved into the printing position after their protective flap bars have been pivoted into the vertical position, for the remaining print bars their protective flap bars are pivoted into the horizontal position, and then the print bars are moved into the park position so that they are covered by their protective flap bars.

8. The method according to claim 7 in which the protective flap bars are arranged in the horizontal position so that the print bars of the printing unit are inserted into the protective flap bars upon being lowered so that the print bars are sealed by the associated protective flap bars.

9. The method according to claim 8 in which the print bars that are used for printing are moved into the printing position and the print bars that are not used for printing remain in the park position and are covered by their protective cap flaps.

10. The method according to claim 9 in which the printing unit with the print bars and the protective flap bars is moved from the operating position into a cleaning position in which the print bars are cleaned by wiper units.

11. A print group for an ink printing apparatus, comprising:

a printing substrate and a printing unit adjacent the printing substrate, said printing unit comprising print bars comprising print heads;

drive and guidance units arranged per print bar moving the print bars independently of one another in a vertical direction from a printing position situated adjacent to the printing substrate into a park position spaced further away from the substrate and back;

a protective flap bar for each print bar comprising a trough and borne so as to be pivotable and the trough being open to one side;

the protective flap bar being arranged in a vertical position next to the print bar in the printing position of said respective print bar such that the open side is facing away from the print bar; and the protective flap bar being arranged in a horizontal position in the park position of the printing unit such that the print bar is engaged with its print head side inserted through the open side in the protective flap bar.

* * * * *